US006782726B2

(12) United States Patent
Armenat et al.

(10) Patent No.: US 6,782,726 B2
(45) Date of Patent: Aug. 31, 2004

(54) HOT-ROLLING MILL WITH FLATNESS MEASURING ROLLER

(75) Inventors: Jürgen Armenat, Kreuztal (DE); Martin Braun, Kreuztal (DE); Reinhard Irle, Hilchenbach (DE)

(73) Assignee: SMS Demag AG, Düseldorf (DE)

( * ) Notice: Subject to any disclaimer, the term of this patent is extended or adjusted under 35 U.S.C. 154(b) by 0 days.

(21) Appl. No.: 10/149,712

(22) PCT Filed: Jan. 10, 2001

(86) PCT No.: PCT/EP01/00185

§ 371 (c)(1),
(2), (4) Date: Jun. 12, 2002

(87) PCT Pub. No.: WO01/51227

PCT Pub. Date: Jul. 19, 2001

(65) Prior Publication Data

US 2002/0184934 A1 Dec. 12, 2002

(30) Foreign Application Priority Data

Jan. 13, 2000 (DE) ..... 100 01 074

(51) Int. Cl.[7] ..... B21B 37/28

(52) U.S. Cl. ..... 72/9.1; 72/11.7; 72/201; 72/251

(58) Field of Search ..... 72/8.3, 9.1, 11.1, 72/11.7, 201, 205, 236, 251

(56) References Cited

U.S. PATENT DOCUMENTS 4,771,622 A * 9/1988 Ginzburg ..... 72/9.1
5,161,398 A * 11/1992 Gore et al. ..... 72/11.7
5,509,285 A * 4/1996 Anbe ..... 72/8.6
5,901,591 A * 5/1999 Kaplan ..... 72/9.1
6,070,472 A * 6/2000 Kipping et al. ..... 73/829

FOREIGN PATENT DOCUMENTS

| | | | |
|---|---|---|---|
| DE | 1427863 | 4/1969 | |
| DE | 3721746 | 1/1989 | |
| DE | 151125 | 4/2003 | |
| EP | 0259107 | 3/1988 | |
| WO | 0041823 | 7/2000 | |
| WO | 03/004963 | * 1/2003 | ..... G01B/5/28 |

OTHER PUBLICATIONS

Patent Abstracts of Japan, vol. 009, No. 303 (M–434), Nov. 30, 1985 & JP 60 141323 A (Kawasaki Jukogyo KK), Jul. 26, 1985.

* cited by examiner

*Primary Examiner*—Ed Tolan
(74) *Attorney, Agent, or Firm*—Friedrich Kueffner

(57) ABSTRACT

The invention relates to a hot rolling mill, with at least one flatness measuring roller, pertaining to at least one rolling bed, arranged before and/or after one of the stands, which influences the settings of at least one of the stands. The aim of the invention is to improve the arrangement of the roller bed working rollers and the flatness measuring roller, such that the flatness measuring roller may be, optionally, either brought into operation, or be withdrawn into a protected position, whereby, in this case, the gap in the rolling bed thus formed can be closed. Said aim is achieved, whereby the flatness measuring roller may be stored, away from its working position, behind a screen and that the rolling bed is completed with at least one retractable working roller.

20 Claims, 5 Drawing Sheets

25
23
24
27
26
22
16
3
1
14
21
20

24'
22'
30
14'
31
14'
32
20'
4'
16'
33
29

24'
22'
35
16'
34
20'
14'
4'
29

HOT-ROLLING MILL WITH FLATNESS MEASURING ROLLER

The invention concerns a hot rolling mill with a flatness measuring roll, which is assigned to at least one roller table positioned before and/or after the stands and which influences the settings of at least one of the stands.

In cold rolling mills, the use of flatness measuring rolls, which influence settings and adjustments of stands to produce stress-free rolled strip, is well known, e.g., to be able to produce unequal rolling forces for the uprights of a stand and/or to produce correcting bending forces. In modern hot rolling processes, strip <1.0 mm is rolled, so the use of flatness measuring rolls would also be suitable here. However, so far they have not been used in hot rolling mills, because, on the one hand, they are relatively sensitive, and, on the other hand, their use in a hot rolling mill train would expose them not only to high temperatures, but also to cooling water, and the resulting high temperature gradients would produce extreme stresses in the roll. In addition, the high incidence of scale places a tremendous amount of stress on the flatness measuring roll and reduces its service life.

The goal of the invention is to design a flatness measuring roll for hot rolling mills in such a way that it is protected, especially from environmental influences.

This goal is achieved by the features specified in claim 1. They make it possible either to move out at least one roller table roll and to move the flatness measuring roll into the resulting gap with its uppermost cylindrical surface line well above the bearing plane of the roller table, and then to lower a holddown roll, or to lower the flatness measuring roll and to fill the resulting gap in the roller table with a roller table roll.

As claim 2 proposes, the flatness measuring roll and the roller table roll can be arranged in a box that can be driven to rotate about an axis in such a way that the flatness measuring roll and the roller table roll can be alternately brought into the working position by rotation, preferably in the same direction. However, as claim 9 proposes, there is also the possibility of arranging the flatness measuring roll and the one or more roller table rolls in a box that can be swiveled about an axis in such a way that the flatness measuring roll and the roller table rolls can be alternately brought into the working position by swiveling them up and down.

Advantageous features and modifications of the invention are described in claims 3 to 8 and 10 to 20.

The invention will be explained in greater detail by describing the specific embodiments of the invention shown in the drawings.

Figure 1:
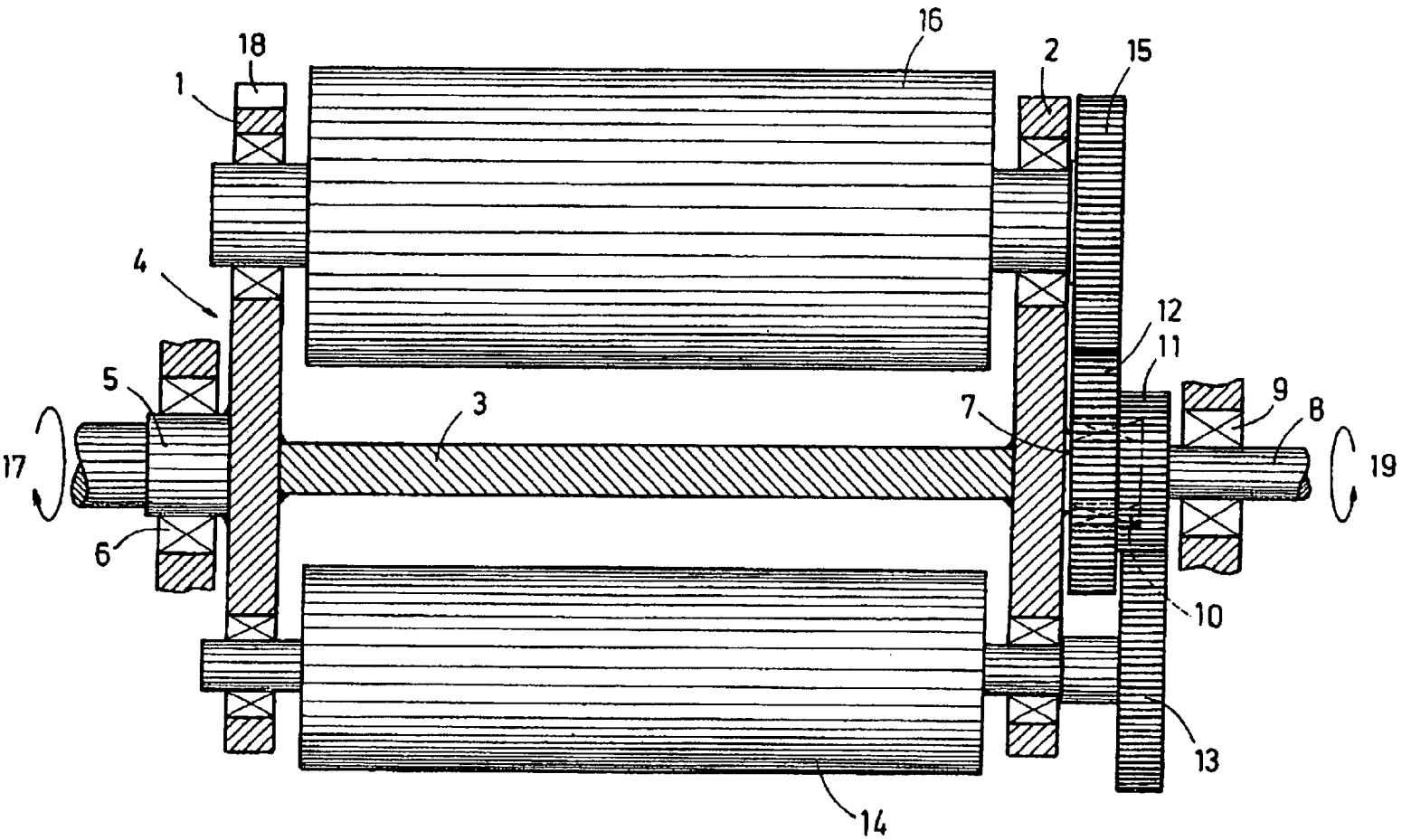
FIG. 1 is a schematic drawing that shows the arrangement of a flatness measuring roll and a roller table roll supported in a rotatable box.

FIG. 1 shows two circular disks 1 and 2, which are joined by a protective plate 3 to form a box 4. On the left side, the box 4 is supported in a bearing 6 by a pivot 5. On the right side, the box 4 has a pivot 7, which is supported in a trunnion 8, which in turn is supported in a bearing 9, and the bearing 10 of the pivot 7 supports surrounding spur gears 11 and 12.

Spur gear 11 mates with gear 13, which is mounted on the drive journal of the roller table roll 14 in such a way that it cannot rotate. Spur gear 12 mates with gear 15, which is mounted on one of the shaft journals of the flatness measuring roll 16 in such a way that it cannot rotate. The roller table roll 14 and the flatness measuring roll 16 are supported in bearings of the circular disks 1 and 2 of the box 4. This provides the following possibilities: To change over from active flatness measuring roll 16 to active roller table roll 14, the pivot 5 is driven in the direction indicated by the arrow 17 by a drive mechanism (not shown), until the box 4 has rotated 180° about its axis of rotation defined by pivots 5 and 7. This rotation may be limited by electromechanical or electronic primary detectors that control the rotation, but it is also possible, for example, to equip circular disk 1 with two catches 18, which are designed as shoulders or indentations, and to bring the disk to rest against a bracket (not shown), which is in contact with the circumference of the disk and is inserted in front of the catch 18, and to hold it or possibly lock it in this position.

It is advantageous to drive the trunnion 8 continuously during the operation in the direction indicated by arrow 19 by drive mechanisms (also not shown in the drawing). The trunnion 8 then drives the spur gears 11 and 12, which may possibly be produced as one piece or as one piece with the trunion. This also drives the roller table roll 14 and the flatness measuring roll 16 by gears 13 and 15, so that when one of these rolls is brought into its operating position, it is already rotating at the peripheral speed corresponding to the rate of feed of the strip that is to be rolled.

It is also important to note that the distance of the bearing of the roller table roll 14 from the axis of rotation of the box 4 is selected in such a way that, when the roller table roll 14 is swung into position, its uppermost cylindrical surface line is aligned with the upper cylindrical surface lines of the other roller table rolls, whereas, when the flatness measuring roll 16, which is usually designed with a larger diameter, is placed in its operating position, its uppermost cylindrical surface line is above the plane of the upper cylindrical surface lines of the roller table.

Figure 2:
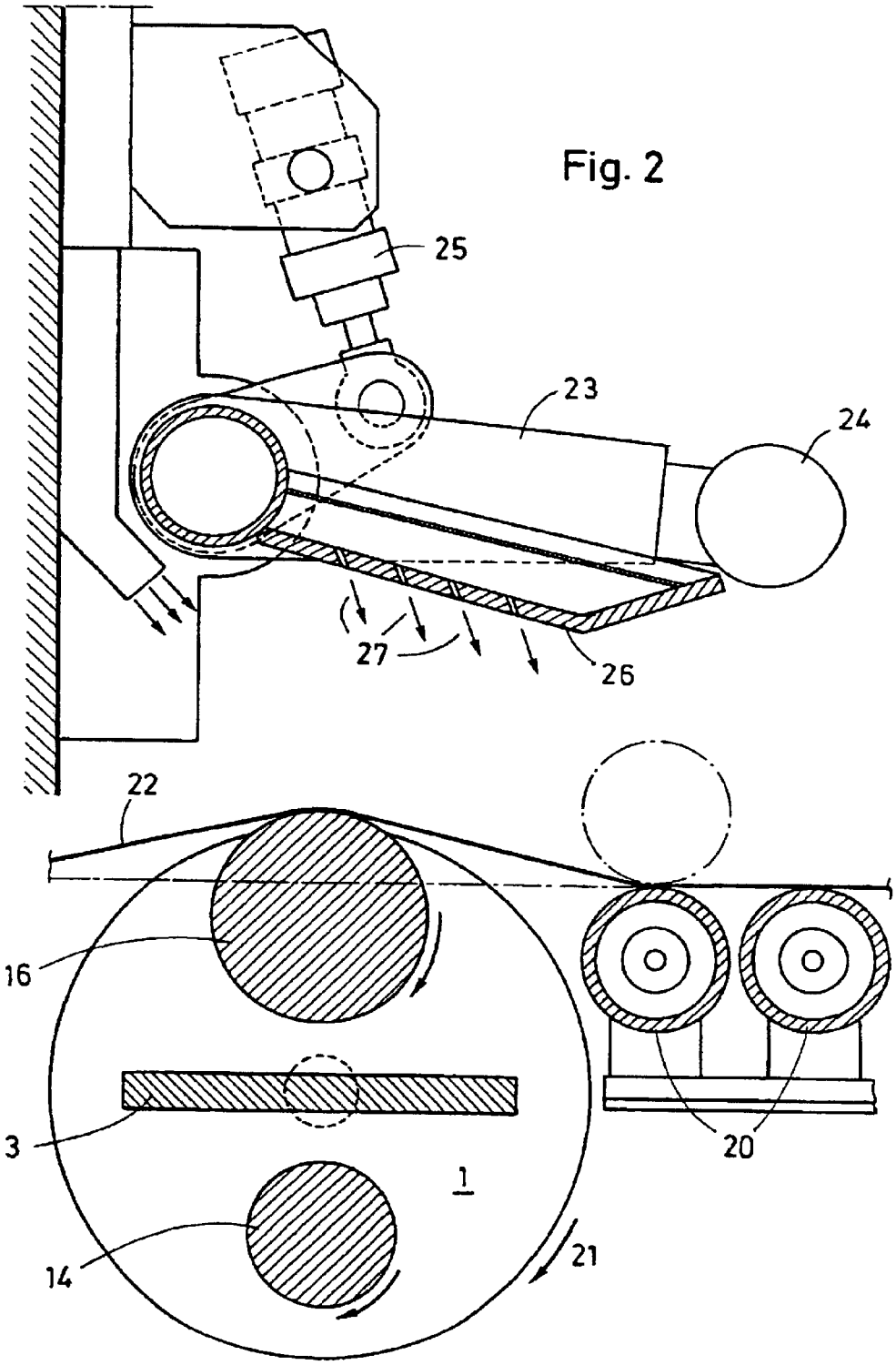
FIG. 2 shows a section of a roller table of a hot rolling mill with the rotatable box that contains the flatness measuring roll and the roller table roll and with a holddown roll that can be lowered into place.

FIG. 2 shows one way of incorporating the box in a section of a hot rolling mill. This drawing shows the roller table 20, from which the roller table roll 14 is swung out and down in the direction indicated by arrow 21, while the flatness measuring roll 16 is swung into position. After the hot rolled strip 22 has run in far enough, the holddown roll 24 supported at the free end of the swivel arm 23 is lowered by the hydraulic cylinder 25. Before this is done, the swivel arm 23 is acted on by compressed air, which emerges from slits in deflector plates 26 as a stream of air indicated by arrows 27 and presses the hot rolled strip 22 against the flatness measuring roll 16 and the roller table 20, a measure which was found to be necessary with thin hot strip. After the holddown roll 24 has been swung down from the raised position shown in FIG. 2 into the position indicated by the dot-dash line, the pivot angle can be used to determine the thickness of the rolled material.

In the embodiment of the invention shown here, it was found to be effective to move the roller table roll 14 or the flatness measuring roll 16 into position in such a way that the hot rolled strip 22 is approached tangentially to avoid excessive forces, and, since both the roller table roll 14 and the flatness measuring roll 16 are moved into position with the same direction of rotation, an advance more or less in the running direction of the hot rolled strip 22 is produced in each of these cases.

The close fitting of extremely thin hot rolled strip is assisted by currents of air, as indicated by arrows 27. The protective plate 3 protects the retracted roll from water, scale, or other stationary parts, as well as from strong water jets and high temperatures, so that the desired protection is achieved. This allows thorough adaptation to the rolling process: The flatness measuring roll 16 is moved into its operating position, preferably after the beginning of the strip has passed, and then the holddown roll 24 is lowered in such a way that, on the one hand, damage to thin hot rolled strip 22 caused by lowering it too fast is avoided, while, on the other hand, the operating position is reached when the following equipment, which picks up the strip, generally a coiler, is firmly holding the strip, so that the strip is properly stretched.

The control operations are effectively carried out by means already well known from the use of flatness measuring rolls in cold rolling mills.

Figure 3:
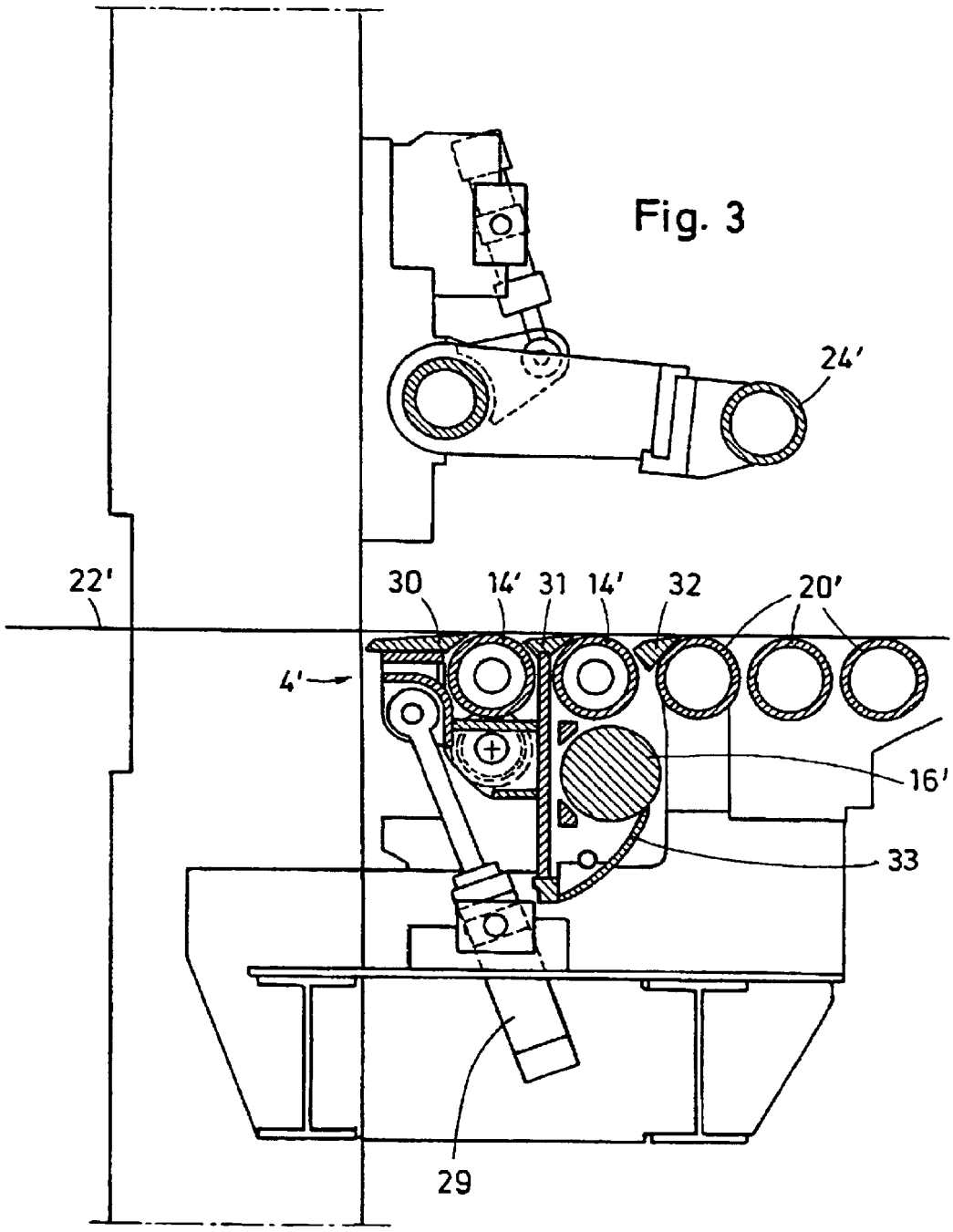
FIG. 3 shows a section of a roller table of a hot rolling mill with a box that contains the flatness measuring roll and that can be swiveled; here the flatness measuring roll has been taken out of its operating position.

It can be useful to equip the box 4 not only with the protective plate 3, but also with other fixtures that shield and protect the flatness measuring roll in its retracted position. FIG. 3 shows a section of a hot rolling mill similar to the one in FIG. 2. In this case, however, the rotatable box 4 is replaced by a swiveling box 4'. The box 4' can be swiveled about a center of rotation 28. A piston-cylinder unit 29, which acts eccentrically on the box 4', serves as the swivel drive.

The box 4' has roller table rolls 14' and a flatness measuring roll 16'. The flatness measuring roll 16' is shown swung out from the bearing plane of the roller table 20'. The roller table rolls 14' fill the resulting gap. The drawing also shows protective devices 30 to 33, which are designed as strip guide platens. The protective devices 30 to 33 protect the flatness measuring roll 16' especially from scale and contaminated cooling water.

In FIG. 3, the swivel arm 23 with holddown roll 24 is brought out of its operating position by the hydraulic cylinder 25.

Figure 4:
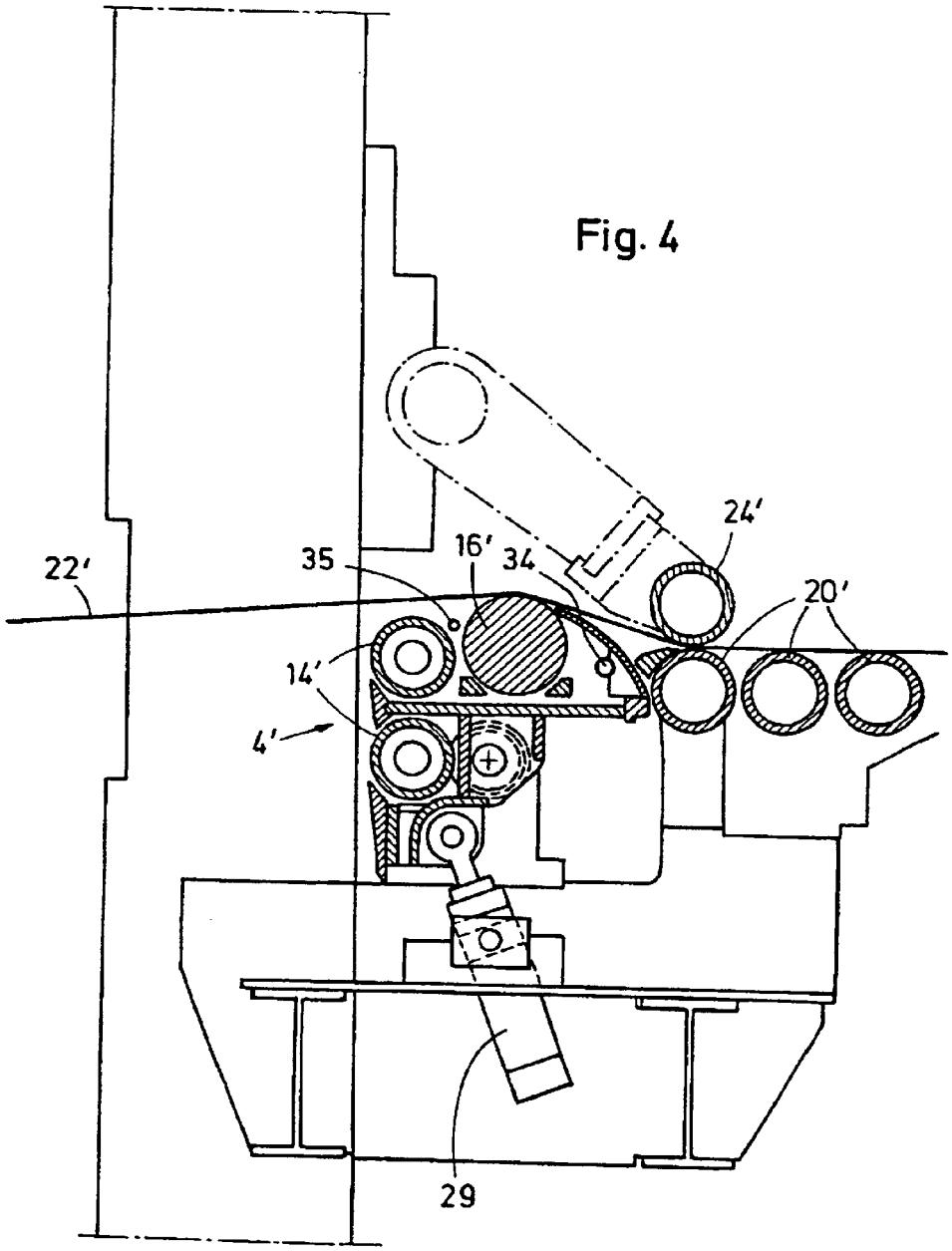
FIG. 4 shows the same section as in FIG. 3, but in this case the flatness measuring roll has been brought into its operating position.

FIG. 4 shows the result of the position-controlled swiveling of the box 4' by the piston-cylinder unit 29. Stops and locking devices (not shown) can hold the box 4' in the operating position, into which the flatness measuring roll 16' was swiveled upward beyond the bearing plane of the roller table 20'. The holddown roll 24 ensures sufficient strip contact with the flatness measuring roll 16'. The flatness measuring roll 16' can be cleaned and cooled by cooling devices 34 and blasting devices 35.

Figure 5:
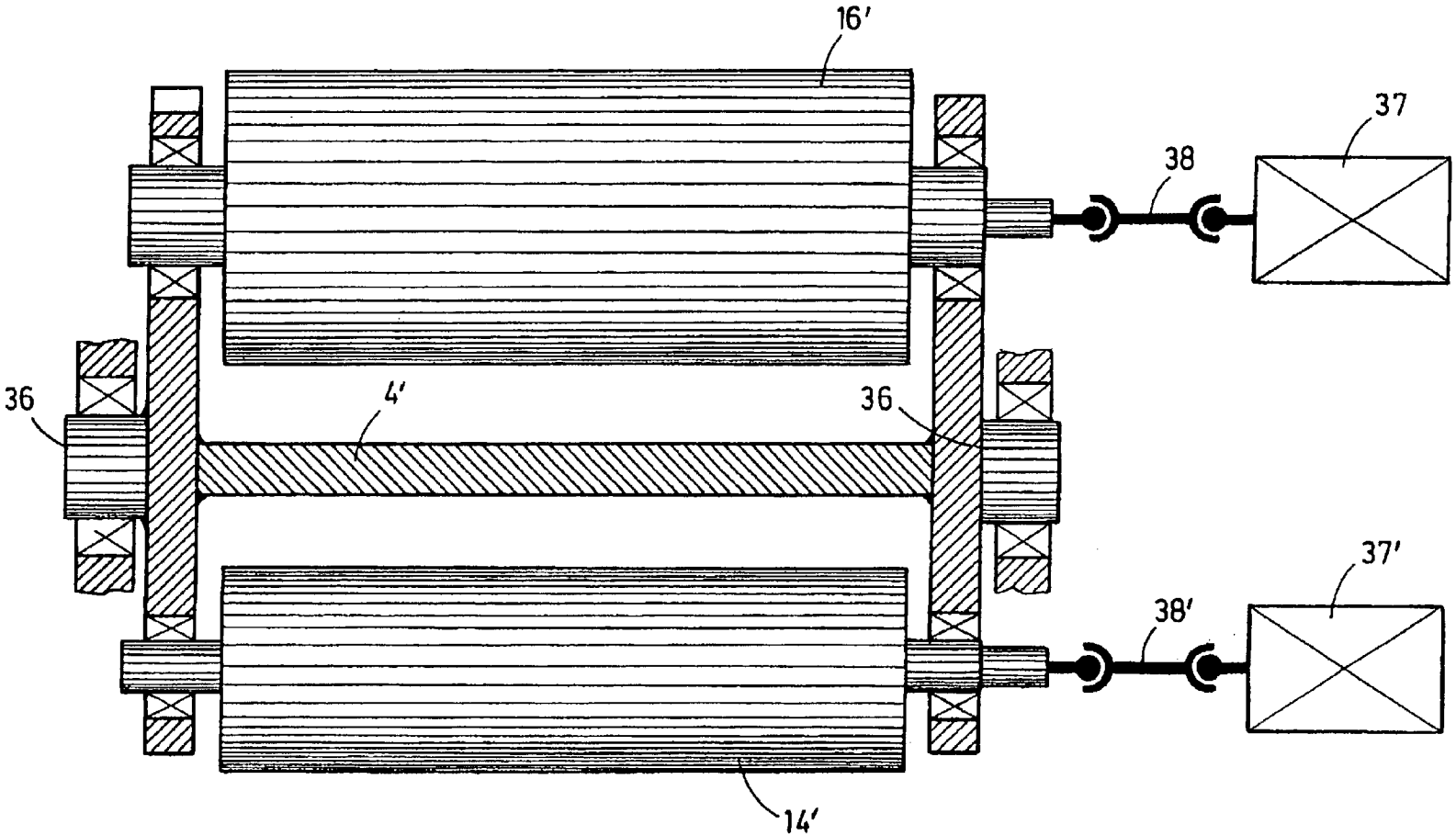
FIG. 5 shows a longitudinal section through a box in accordance with FIG. 3 or 4 with the flatness measuring roll and the roller table roll, including drive mechanisms.

FIG. 5 shows the box 4', which can be swiveled about the pivots 36. The roller table rolls 14' and the flatness measuring roll 16' are driven by separate drives 37, 37' and corresponding shafts 38 and 38'.

| List of Reference Numbers |
|---|
| 1. circular disk |
| 2. circular disk |
| 3. protective plate |
| 4. box |
| 5. pivot |
| 6. bearing |
| 7. pivot |

-continued

| List of Reference Numbers |
|---|
| 8. trunnion |
| 9. bearing |
| 10. bearing |
| 11. spur gear |
| 12. spur gear |
| 13. gear |
| 14. roller table roll |
| 15. gear |
| 16. flatness measuring roll |
| 17. arrow |
| 18. arrow |
| 19. rotational arrow |
| 20. roller table |
| 21. arrow |
| 22. hot rolled strip |
| 23. swivel arm |
| 24. holddown roll |
| 25. hydraulic cylinder |
| 26. deflector plates |
| 27. arrows |
| 28. center of rotation |
| 29. piston-cylinder unit |
| 30. protective device |
| 31. protective device |
| 32. protective device |
| 33. protective device |
| 34. cooling device |
| 35. blasting device |
| 36. pivot |
| 37. drive |

What is claimed is:

1. Hot rolling mill with a flatness measuring roll (16, 16'), which is assigned to at least one roller table (20, 20') positioned before and/or after the stands and which influences settings of at least one of the stands, wherein the flatness measuring roll (16, 16') is movable from its operating position into a shielded position, and a resulting gap in the roller table (20, 20') is then filled by at least one roller table roll (14, 14'), which is swivelable into position in the roller table.

2. Hot rolling mill in accordance with claim 1, wherein the flatness measuring roll (16) and the roller table roll (14) or roller table rolls are mounted in a box (4) formed by two circular disks (1, 2), which is rotatable about an axis, and that they are mounted in the box (4) in such a way that the flatness measuring roll (16) and the roller table roll (14) are alternately movable into the working position by rotation (arrow 21) in the same direction.

3. Hot rolling mill in accordance with claim 2, wherein the box (4) has pivots (5, 7) on both sides, that a drive mechanism (arrow 17) is assigned to one of the pivots (5) to rotate the box (4), and that the other pivot (7) is supported (10) in a driven trunnion (8) with the drive mechanism (arrow 19) that drives the flatness measuring roll (16) and the roller table roll (14).

4. Hot rolling mill in accordance with claim 3, wherein the pivot (7) of the box (4) is provided with the bearing (10) in the trunnion (8) and/or in the spur gears (11, 12) connected with the trunnion (8).

5. Hot rolling mill in accordance with claim 3, wherein the trunnion (8) drives the flatness measuring roll (16) and the roller table roll (14) by the gear train (11, 12, 13, 15) at a peripheral speed that corresponds to the rate of feed of the hot rolled strip (22) over the roller table (20).

6. Hot rolling mill in accordance with claim 2, wherein at least one of the circular disks (1, 2) has a catch (18), which is lockable by a stop device.

7. Hot rolling mill in accordance with claim 1, wherein the flatness measuring roll (16) is completely protected by a protective plate (3) when it has been moved out of its operating position.

8. Hot rolling mill in accordance with claim 1, wherein the flatness measuring roll (16) and the roller table roll (14) are driven by a system of gears (11, 12, 13, 15).

9. Hot rolling mill in accordance with claim 1, wherein the flatness measuring roll (16') and the one or more roller table rolls (14') are mounted in a box (4') that is swivelable about pivots (36) in such a way that the flatness measuring roll (16') and the roller table rolls (14') are alternately swiveled up and down into the operating position.

10. Hot rolling mill in accordance with claim 9, wherein the flatness measuring roll (16') and the roller table rolls (14') are driven by separate drives (37, 37').

11. Hot rolling mill in accordance with claim 10, wherein the drives (37, 37') are continuously variable in their speed and/or torque.

12. Hot rolling mill in accordance with claim 9, wherein a piston-cylinder unit (29) serves as the swivel drive for the box (4').

13. Hot rolling mill in accordance with claim 12, wherein the piston-cylinder unit (29) is operated by position control.

14. Hot rolling mill in accordance with claim 9, wherein the box (4') and the holddown roll (24') have stops that define an end position of the operating position.

15. Hot rolling mill in accordance with claim 1, wherein the flatness measuring roll (16') is protected by protective devices (30 to 33) when it has been moved out of its operating position.

16. Hot rolling mill in accordance with claim 15, wherein the protective devices (30 to 33) are designed as guide platens.

17. Hot rolling mill in accordance with claim 1, wherein cooling devices (34) are assigned to the flatness measuring roll (16, 16').

18. Hot rolling mill in accordance with claim 1, wherein blasting devices (35) are assigned to the flatness measuring roll (16, 16').

19. Hot rolling mill in accordance with claim 1, wherein directable nozzle openings that are supplied with compressed air are provided on the roller table (20, 20') in front of, on, and/or after the flatness measuring roll (16, 16').

20. Hot rolling mill in accordance with claim 1, wherein position-controlled holddown rolls (24, 24') are able to affect the degree of contact of the strip with the flatness measuring roll (16, 16').

* * * * *